US007380414B2

(12) United States Patent
Lehman et al.

(10) Patent No.: US 7,380,414 B2
(45) Date of Patent: Jun. 3, 2008

(54) METHOD AND SYSTEM FOR TREATING AN OXYGEN-RICH LIQUID BATH COLLECTED AT THE FOOT OF A CRYOGENIC DISTILLATION COLUMN

(75) Inventors: Jean-Yves Lehman, Maisons-Alfort (FR); Bernard Saulnier, La Garenne Colombes (FR)

(73) Assignee: L'Air Liquide, Societe Anonyme A Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 357 days.

(21) Appl. No.: 10/552,124

(22) PCT Filed: Mar. 29, 2004

(86) PCT No.: PCT/FR2004/050132

§ 371 (c)(1),
(2), (4) Date: Oct. 5, 2005

(87) PCT Pub. No.: WO2004/092670

PCT Pub. Date: Oct. 28, 2004

(65) Prior Publication Data

US 2006/0075778 A1 Apr. 13, 2006

(30) Foreign Application Priority Data

Apr. 10, 2003 (FR) ..... 03 50097

(51) Int. Cl.
*F25J 3/00* (2006.01)

(52) U.S. Cl. ..... 62/643; 62/903

(58) Field of Classification Search ..... 62/643, 62/903, 908
See application file for complete search history.

(56) References Cited

U.S. PATENT DOCUMENTS

| | | | | |
|---|---|---|---|---|
| 2,650,482 A | | 9/1953 | Lobo | |
| 2,664,719 A | | 1/1954 | Rice et al. | |
| 4,337,070 A | | 6/1982 | Rohde | |
| 4,594,085 A | * | 6/1986 | Cheung | 62/646 |
| 5,071,458 A | | 12/1991 | Grenier | |

(Continued)

FOREIGN PATENT DOCUMENTS

EP 0 447 943 9/1991

(Continued)

OTHER PUBLICATIONS

International Search Report for PCT/FR04/050132.

*Primary Examiner*—William C Doerrler
(74) *Attorney, Agent, or Firm*—Elwood Haynes

(57) ABSTRACT

Methods and apparatus for treating a liquid bath of oxygen. A liquid bath of at least 70 mol % of oxygen is located at the base of a cryogenic distillation column. The bath is continuously boiled by an aluminum reboiler. A portion of the liquid bath is purged to prevent a build up of inflammable impurities in the bath. A portion of the purge is sent to a second reboiler, which is less inflammable than the first reboiler. Oxygen boiled by the second reboiler is sent back to the column, and a portion of the oxygen rich liquid bath treated by the second reboiler is also purged. The invention also relates to an apparatus of carrying out this method.

5 Claims, 1 Drawing Sheet

U.S. PATENT DOCUMENTS

| | | | | |
|---|---|---|---|---|
| 6,347,662 | B1 | 2/2002 | Davidian et al. | |
| 6,351,968 | B1 * | 3/2002 | Habicht et al. | 62/643 |
| 6,360,561 | B2 * | 3/2002 | Allam et al. | 62/654 |
| 6,393,864 | B1 | 5/2002 | Darredeau | |

FOREIGN PATENT DOCUMENTS

| | | |
|---|---|---|
| WO | WO 99 39143 | 8/1999 |

* cited by examiner

METHOD AND SYSTEM FOR TREATING AN OXYGEN-RICH LIQUID BATH COLLECTED AT THE FOOT OF A CRYOGENIC DISTILLATION COLUMN

BACKGROUND

The invention relates to the field of cryogenic air separation and more particularly to cryogenic methods in which an oxygen-rich liquid bath has to be boiled.

The cryogenic distillation of air is carried out in distillation columns, and in the sump of some of these columns an oxygen-rich liquid is collected, in particular in the low-pressure column of a system of columns, such as a double air separation column. This oxygen-rich liquid is continuously boiled so as to provide reboil for the column, by means of a reboiler that is installed in the sump and fed with a heat-transfer fluid, such as the gaseous nitrogen collected at the top of the column.

This boiling of the oxygen progressively results in a progressive increase in the concentration in the liquid bath treated by the reboiler of impurities heavier than oxygen. These compounds include light hydrocarbons, $CO_2$ and nitrogen oxides. This concentration is dangerous long term, since a threshold may then be reached above which, in certain zones of the reboiler where the liquid oxygen is completely boiled off, a deposit of hydrocarbons in the pure state may be produced on the reboiler, resulting in combustion of said hydrocarbons. This combustion may propagate to the aluminum which, for cost and energy efficiency reasons, is generally the base material from which the reboiler is made. Moreover, the build-up of inert compounds may also be dangerous when these compounds solidify in a quantity such that they block the channels of the reboiler. It is then necessary to shut down the installation in order to restore it to correct operation.

A partial solution to this problem could be to replace the aluminum reboiler with a copper reboiler, which runs no risk of catching fire in contact with hydrocarbons. However, this solution would be expensive, in particular because the exchanger would have to have substantially greater dimensions, for the same performance, than an aluminum exchanger.

Another solution, conventionally adopted, consists in purging a portion of the oxygen-rich liquid. Such a purge takes place naturally if the installation is used to produce liquid oxygen or gaseous oxygen at high pressure, by what is called the "internal compression" method, or low-pressure gaseous oxygen. However, if the oxygen is withdrawn from the column above the reboiler (something which is the case in installations producing krypton or xenon), or if the liquid oxygen withdrawn is only partially vaporized and if its unvaporized portion is sent back into the column, the problem rises in the same manner. Under these conditions, it is necessary either to purge a large stream of liquid oxygen, to send it through absorbers, in order to strip it of its impurities, and to send it back into the reboiler, or to withdraw only a small stream of liquid oxygen, but to discharge it to the outside of the system without utilizing it. Since this latter solution is costly in terms of wasted material and energy, it is beneficial to minimize as far as possible the fraction of liquid oxygen purged.

If the air treated by the cryogenic distillation installation is very clean, the purge stream may be as low as 0.01% of the total treated air stream. However, in common practice the purge stream is from 0.1 to 0.2% of the total treated air stream. The lower the purge stream, for the same initial air purity, the higher the risk of a dangerous build-up of hydrocarbons and other impurities in the oxygen-rich liquid. It is estimated in general that, with a purge stream of 10% of the total treated air stream or higher, there is no longer any danger in using an aluminum reboiler.

One solution proposed by the document WO-A-99/39143 consists in purging a fraction of oxygen-rich liquid that is sufficiently large to ensure safe operation of the reboiler and in sending the purged liquid into a second reboiler external to the installation, in which high impurity contents of the concentrated liquid found therein can be tolerated and in managing the corresponding risk. This external reboiler may be periodically warmed to a relatively high temperature so as to remove the impurities that are present therein.

SUMMARY

The invention includes both methods and apparatus to achieve the desired results, as described, but is not limited to the various embodiments disclosed.

The object of the invention is to propose an alternative solution to that which has just been described, in which any risk of explosion of any reboiler would be eliminated and would be easier to manage, while still making it possible to finally discharge out of the installation only a minimal amount of treated air.

For this purpose, the subject of the invention is a method of treating a liquid bath containing at least 70 mol % oxygen collected in the bottom of a cryogenic distillation column or column element forming part of a system of columns that is used for the separation of air, in which said liquid bath is continuously boiled by means of at least a first reboiler made of aluminum, a portion of said oxygen-rich liquid bath is purged so as to prevent an excessive build-up of inflammable impurities in said bath, said purged portion is sent into at least a second reboiler, the oxygen boiled by said second reboiler is sent back into said cryogenic distillation column and a portion of the oxygen-rich liquid bath treated by said second reboiler is purged, characterized in that the second reboiler is, by its construction and/or its material, less inflammable than the first reboiler.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
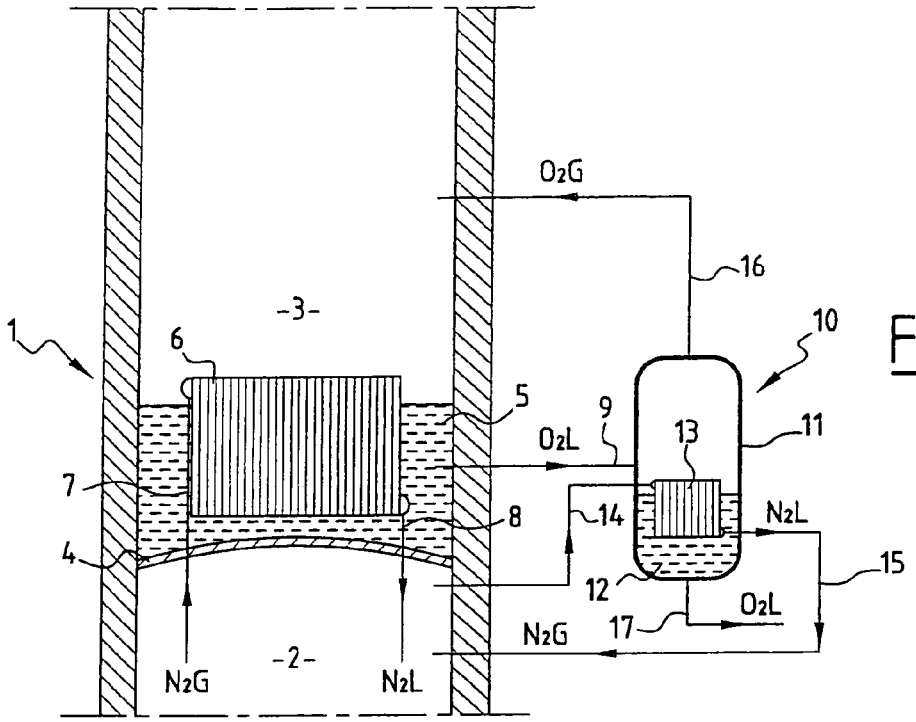
FIG. 1 illustrates a schematic representation, according to one embodiment of the current invention, of a cryogenic air distillation column.

The invention is a method of treating a liquid bath containing at least 70 mol % oxygen collected in the bottom of a cryogenic distillation column or column element forming part of a system of columns that is used for the separation of air, in which said liquid bath is continuously boiled by means of at least a first reboiler made of aluminum, a portion of said oxygen-rich liquid bath is purged so as to prevent an excessive build-up of inflammable impurities in said bath, said purged portion is sent into at least a second reboiler, the oxygen boiled by said second reboiler is sent back into said cryogenic distillation column and a portion of the oxygen-rich liquid bath treated by said second reboiler is purged, characterized in that the second reboiler is, by its construction and/or its material, less inflammable than the first reboiler.

According to other optional aspects:

said purged portion sent into said second reboiler represents at least 0.5 mol % of the total air stream feeding the system of distillation columns;

said purged portion sent into said second reboiler represents at least 10 mol %, preferably at least 20 mol %, of the total air stream feeding the system of distillation columns;

oxygen-rich liquid treated by said second reboiler is purged as a stream equal to at most 1% of the total air stream feeding the system of distillation columns; and oxygen-rich liquid treated by said second reboiler is purged as a stream equal to at most 0.2% of the total air stream feeding said distillation column.

The subject of the invention is also a cryogenic distillation column or column element, in the sump of which at least a first aluminum reboiler for treating an oxygen-rich liquid bath is placed, comprising purge means for taking a portion of said bath into at least a second reboiler, means for sending the oxygen vaporized by said second reboiler back into said column, and means for purging a portion of said bath sent into said second reboiler, characterized in that the second reboiler is by its construction and/or its material less inflammable than the first reboiler.

According to other aspects of the invention:

said at least second reboiler is placed in the bottom of a heat exchanger placed outside said column;

the cryogenic distillation column or column element includes a partition that divides its sump into a first compartment and a second compartment, in that said at least first reboiler is placed in the first compartment, in that said at least second reboiler is placed in the second compartment and in that said partition has a height such that it allows the second compartment to be fed with oxygen-rich liquid coming from the first compartment by overflow; and the cryogenic distillation column or column element, characterized in that it includes means for measuring the level of oxygen-enriched liquid present in the compartments defined by the partition.

The subject of the invention is also an air distillation unit comprising a cryogenic distillation column, characterized in that the column, in the sump of which the first reboiler is placed, is the low-pressure column of a double column comprising a medium-pressure column and the low-pressure column, these columns being thermally coupled to each other by means of the first reboiler, and comprising means for sending a nitrogen-enriched gas from the medium-pressure column to the first reboiler and optionally to the second reboiler.

As will have been understood, the basic idea of the invention consists in purging the aluminum reboiler(s) conventionally used by sending the purged liquid into at least one other reboiler made of a metal such as copper, which may be placed either on the inside or on the outside of the column. The copper reboiler can tolerate, without posing a hazard, high concentrations of impurities in the oxygen-rich liquid that it treats, and it is possible to purge only a minimal amount of liquid from this copper reboiler. The boiled oxygen is sent back into the column and an excellent material balance is obtained in the operation of cryogenically separating the initial mixture (generally air), while still maintaining a very satisfactory level of operating safety of the installation. Of course, copper is only one example of metal that can be used to form the other reboiler—any other metal exhibiting comparable noninflammability and thermal conductivity characteristics could be used.

FIG. 1 shows a portion of a cryogenic air distillation installation 1 comprising, as is known, two columns, one on top of the other. The lower part of this installation is made up of a medium-pressure column 2 and the upper part of the installation 1 is made up of a low-pressure column 3. These two columns are separated by a partition 4. A liquid bath 5 very rich in oxygen (at least 70%, with contents of 95% or higher commonly obtained) collects in the bottom of the low-pressure column 3. This bottom of the low-pressure column 3 also contains an aluminum reboiler 6. Its function is to ensure that the liquid oxygen contained in the liquid 5 is boiled, so as to provide reboil for the low-pressure column 3. Inside this reboiler, heat exchange is provided by means of nitrogen taken off from the top of the medium-pressure column 2 via a line 7 that introduces the nitrogen in the gaseous state into the reboiler 6. As is known, the heat exchange inside the reboiler causes this gaseous nitrogen to condense, which returns in liquid form to the low-pressure column 2 via a line 8. As is also known, a portion of the oxygen-rich liquid 5 is purged out of the low-pressure column 3, by means of a line 9, so as to limit the concentration of impurities in the oxygen-rich bath 5.

According to the invention, this liquid oxygen purged via the line 9 is introduced into a heat exchanger 10. In the embodiment shown in FIG. 1, this exchanger 10 is located outside the cryogenic separation installation. It is made up of a tank 11 in the bottom of which oxygen-rich liquid 12 is deposited. The bottom of the tank 11 also contains a copper reboiler 13, the role of which is to boil off the oxygen contained in the bath 12. This copper reboiler 13 is, like the aluminum reboiler 6 of the cryogenic separation installation 1, supplied with gaseous nitrogen taken off from the medium-pressure column by means of a line 14. This gaseous nitrogen condenses in the copper reboiler 13, and a line 15 withdraws the nitrogen from the reboiler 13 and returns it to the medium-pressure column 2. A line 16 tapped off the top of the exchanger 10 returns the gaseous oxygen into the low-pressure column 3, while a line 17 purges a fraction of the liquid 12, this fraction therefore constituting the only amount of oxygen-rich liquid discharged from the entire installation.

The copper reboiler 13 may be replaced with a reboiler made of copper or made of another metal, such as aluminum, but which by its construction is less inflammable than the reboiler 6, for example the second reboiler may be a tubular reboiler.

The second reboiler is located inside the cold box that serves to insulate the column system 1.

The stream of oxygen-rich liquid 5 sent via the line 9 into the exchanger 10 is an operating parameter of the installation that can be controlled at will by the user. If it is desired to ensure that, whatever the initial cleanliness of the air treated by the distillation installation 1, there is strictly no hazard in this liquid 5 having an excessively high concentration of impurities, the stream of liquid 5 sent into the line 9 must be greater than or equal to 10% of the total quantity of air treated by the column 1. Of course, if air having a relatively high initial purity is treated, a substantially smaller purge stream in permissible. A purge stream of oxygen-rich liquid 5 into the exchanger 10 of at least 0.5% is accepted as being a good overall balance between economic considerations (which recommend a small stream in order not to have to have an excessively large exchanger 10) and safety considerations (which recommend a high purge stream in order to ensure that too high an impurity concentration in the oxygen-rich liquid 5 of the low-pressure column 3 is not exceeded).

The other important parameter of the installation according to the invention that has to be controlled is the purge stream of oxygen-rich liquid 12 present inside the exchanger 10 and discharged via the line 17. It is this purge stream that represents the only part of the materials treated by the installation that will be discharged and finally lost, if it does not undergo a subsequent treatment. Of course, it is advantageous to limit this purge stream to the lowest possible value, compatible with the safe operating requirements of the installation, and in particular of the exchanger 10. Since the reboiler 13 of this exchanger 10 is made of copper, it is capable of tolerating very substantially higher inflammable impurity concentrations than an aluminum reboiler could. Under these conditions, a purge stream passing via the line 17 of generally less than 1% of the total air stream treated by the installation is imposed. An economic calculation shows that above this 1% value, it often becomes less expensive in terms of energy to carry out irreversible boiling of the oxygen-rich liquid 5 purged outside the installation. This said, even with air treated by the installation that is initially highly laden with inflammable impurities, it is possible in complete safety to purge quantity of oxygen-rich liquid via the line 17 of the exchanger 10 of less than 0.2% of the total quantity of air treated by the installation.

Figure 2A:
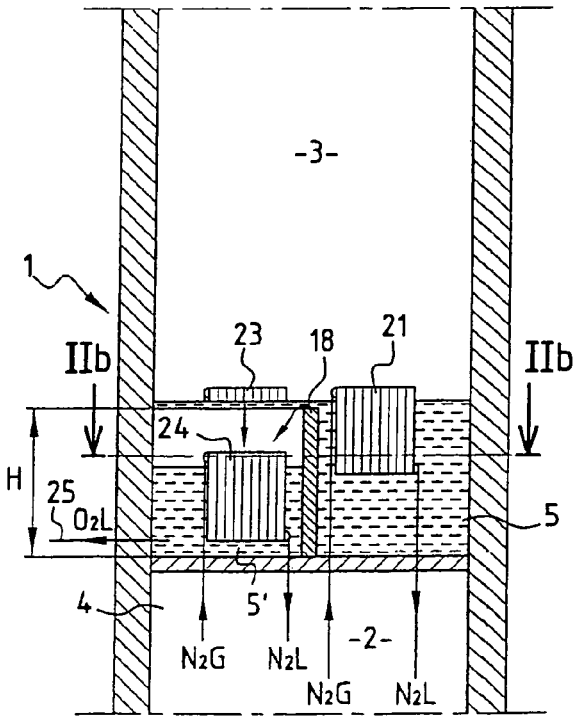
FIG. 2*a* illustrates a schematic representation, according to another embodiment of the current invention, of a cryogenic air distillation column.
Figure 2B:
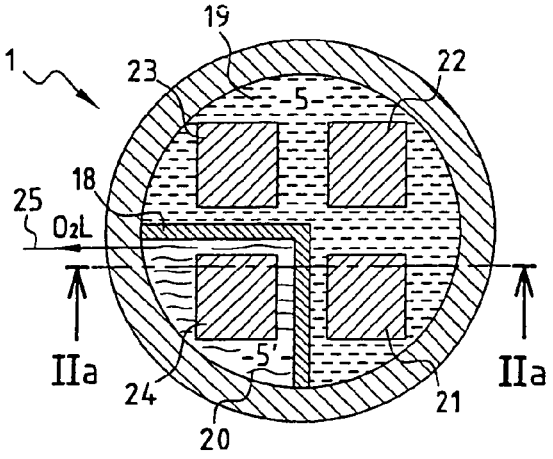
FIG. 2*b* illustrates a sectional view of the embodiment shown in FIG. 2*a*.

The size of the exchanger 10 and of the copper reboiler 13 that contains it depend tightly on the stream of oxygen-rich liquid 5 that they have to treat. The greater this stream, the larger the exchanger 10 and the reboiler 13 have to be. If the space available outside the column 1 is relatively limited, the exchanger 10 can only be small in size—under these conditions, the installation will be able to treat only a rather limited stream of oxygen-rich liquid 5. This type of installation, as shown in FIG. 1, is therefore to be recommended more for cases in which the air treated by the cryogenic separation column 1 already has at the start a relatively high purity. Otherwise, it may be recommended to use an installation according to the invention as shown in FIG. 2.

In this example, the sump of the low-pressure column 3 is divided into two compartments by a partition 18 of height H. In the example shown, the partition 18 forms a corner, the first compartment 19 representing about three-quarters of the bottom of the low-pressure column 3 and the second compartment 20 representing the remaining quarter. At least one aluminum reboiler 20, 21 or 23 is installed in the first compartment 19 (or several of them, as in the example shown), and at least one copper reboiler 24 is installed in the compartment 20. The height H of the partition 18 is calculated in such a way that the oxygen-rich liquid 5 present in the first compartment 19, when the low-pressure column 3 is operating in the steady state, spills over the top of the partition 18 so as to pass into the second compartment 20. This stream of liquid 5 flowing out of the first compartment 19 into the second compartment 20 therefore represents the purge stream of the oxygen-rich liquid. On entering the second compartment 20, the purged liquid forms a bath 5', which is treated by the copper reboiler 24. This treatment enriches the bath 5' with impurities. Since the reboiler 24 is made of copper, this impurity enrichment can be tolerated without prejudicing the safety operating conditions of the installation. A line 25 purges the liquid 5' rich in oxygen and in impurities present in the second compartment 20, in a manner similar to the line 17 of the first embodiment of the invention, shown in FIG. 1.

The copper reboiler 24 may be as large as permitted by the internal space in the low-pressure column 3, relative to the size of the aluminum reboiler or reboilers 21, 22, 23 needed for treating the oxygen-rich bath 5. The installation is preferably provided with means for detecting the levels reached by the oxygen-rich liquid 5, 5' in the compartments 19, 20 defined by the partition 18. In this way, the operation of the installation can be controlled, especially by regulating the purge stream flowing in the line 25, in particular so as to prevent the return of liquid oxygen 5' concentrated in impurities into the first compartment 19 from the second compartment 20.

A gaseous oxygen stream (not illustrated) is withdrawn from the bottom of the low-pressure column 3 and warmed in the exchange line of the unit in order to form a gaseous product. The unit may also produce liquid products. However, it is not possible to use this kind of unit to produce gaseous oxygen by boiling a pressurized liquid stream.

In order for the installation to be operated properly, it is advantageous to give the inside of the column 3 a configuration such that the impurity-depleted liquid oxygen flowing down the column 3 preferentially runs into the first compartment 19 containing the aluminum reboiler or reboilers 21, 22, 23. Likewise, it is recommended to promote mixing of this impurity-depleted liquid oxygen with the liquid oxygen 5 already present in the first compartment 19. As a variant, for all the examples that have been described, it is possible to operate the various reboilers not using gaseous nitrogen withdrawn from the top of the medium-pressure column 2, but with air or any other heat-transfer fluid whose feed would be independent of the rest of the cryogenic separation column 1.

Of course, the invention is applicable to any type of cryogenic distillation column in the sump of which an oxygen-rich liquid requiring to be purged collects, the double-column installation described being only a preferred example.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method which may be used for treating a liquid bath of oxygen, said method comprising:

a) providing a liquid bath in the bottom of a cryogenic distillation column or a column element, wherein:
   1) said liquid bath comprises at least about 70 mol % oxygen; and
   2) said column or column element forms part of a system of columns that are used for the separation of air;

b) boiling continuously a portion of said liquid bath with at least one first reboiler, wherein said first reboiler is made of aluminum;

c) purging a portion of said liquid bath, wherein said purging prevents an excessive build up of inflammable impurities in said bath;

d) sending said purged portion to at least one second reboiler, wherein said second reboiler is less inflammable than said first reboiler;

e) sending oxygen boiled by said second reboiler back to said column; and f) purging a portion of the oxygen rich liquid bath treated by said second reboiler, wherein said purged portion sent to said second reboiler is at least about 10 mol % of said total air stream feeding said system of distillation columns.

2. The method of claim 1, wherein said purged portion sent to said second reboiler is at least about 20 mol % of said total air stream feeding said system of distillation columns.

3. An apparatus which may be used for the cryogenic distillation of air, said apparatus comprising:

a) a cryogenic distillation column or column element, wherein said column comprises a sump;

b) at least one first aluminum reboiler for treating an oxygen rich liquid bath, wherein said first aluminum reboiler is located in said sump;

c) a first purge, wherein:

1) said first purge sends at least a portion of said bath into at least one second reboiler; and 2) said second reboiler is less inflammable than said first reboiler;

d) a conduit which sends oxygen vaporized by said second reboiler back into said column; and e) a second purge, wherein said second purge purges a portion of said bath in said second reboiler, further comprising a partition located in said column, wherein:

f) said partition divides said sump into a first compartment and a second compartment;

g) said first reboiler is located in said first compartment;

h) said second reboiler is located in said second compartment; and i) said partition has a height such that said second compartment is fed oxygen rich liquid by overflow from said first compartment.

4. The apparatus of claim 3, further comprising a measuring device, wherein said device measures the level of said oxygen rich liquid present in said first and said second compartments.

5. An apparatus which may be used for cryogenic distillation of air, said apparatus comprising:

a) a low pressure column, wherein said low pressure column comprises a sump;

b) at least one first aluminum reboiler for treating an oxygen rich liquid bath, wherein said first aluminum reboiler is located in said sump;

c) a medium pressure column, wherein said medium pressure column is thermally coupled to said low pressure column by said first aluminum reboiler;

d) at least one partition located in said sump;

e) at least one second reboiler, wherein:

1) said second reboiler is located in said sump;

2) said partition separates said first reboiler and said second reboiler; and 3) said second reboiler is less inflammable than said first reboiler;

f) a first purge, wherein said first purge sends at least a portion of said oxygen rich liquid bath to said second reboiler;

g) a conduit which sends oxygen vaporized by said second reboiler back into said low pressure column;

h) a second purge, wherein said second purge purges at least a portion of said oxygen rich liquid bath in said second reboiler; and i) a nitrogen conduit connecting said medium pressure column with said first reboiler.

* * * * *